United States Patent [19]

Gregoire

[11] 3,949,591

[45] Apr. 13, 1976

[54] BENDER FOR DIE CUTTERS AND PERFORATORS FOR THE PRINTING INDUSTRY

[75] Inventor: Clyde G. Gregoire, Bensenville, Ill.

[73] Assignee: Gregg Engineering Corporation, Lyons, Ill.

[22] Filed: Nov. 11, 1974

[21] Appl. No.: 522,892

[52] U.S. Cl. ..... 72/310; 72/219; 72/388

[51] Int. Cl.[2] ..... B21D 5/04

[58] Field of Search ..... 72/217, 219, 310, 318, 72/321, 388

[56] References Cited

UNITED STATES PATENTS

| | | | |
|---|---|---|---|
| 2,266,912 | 12/1941 | Shaw, Jr. | 72/219 |
| 2,369,923 | 2/1945 | Shaw, Jr. | 72/388 |
| 2,382,901 | 8/1945 | Newsome et al. | 72/219 |
| 2,466,381 | 4/1949 | Clouse | 72/158 |
| 3,125,150 | 3/1964 | Lubow | 72/388 |
| 3,452,581 | 7/1969 | Frederiksen | 72/388 |
| 3,584,492 | 6/1971 | Dodge | 72/310 |

FOREIGN PATENTS OR APPLICATIONS

| | | | |
|---|---|---|---|
| 560,395 | 4/1944 | United Kingdom | 72/217 |
| 146,576 | 7/1920 | United Kingdom | 72/219 |
| 719,163 | 11/1954 | United Kingdom | 72/217 |

*Primary Examiner*—Victor A. DiPalma
*Attorney, Agent, or Firm*—Kenneth T. Snow

[57] ABSTRACT

A bender and shaper for die cutters and perforators for the printing industry. The die cutters and perforators are generally an inverted "T" shape with the center leg of the "T" constituting the knife or perforator. The bender grips the side flanges of the "T" and with a swinging arm causes the cutters or perforators to be bent around the circumference of the wheel members employed to grip the side flanges. Various desired shapes of die cutters and perforators may be made without distortion of the cutting or perforating edges.

4 Claims, 7 Drawing Figures

69
70
71
15
68
66
57
56
55
63
19
68
65
39
28
3
3
49
26
23
37
36
51
52
68
53
54
64

23
37
36
21
38
57
55
19
15
53
54
52
39
71
16
18
13
22
14
24
12
11
20
17
20
10

Fig. 3.
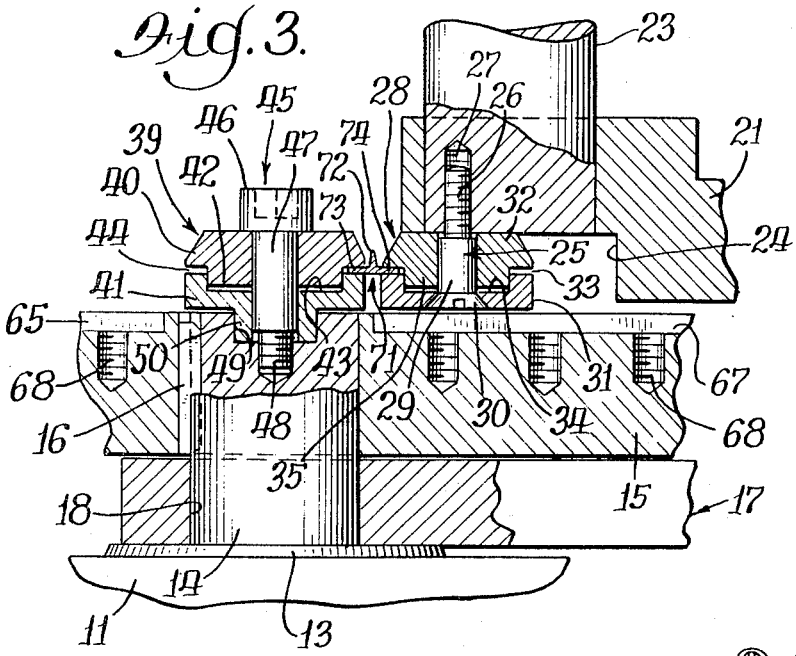
Fig. 5.
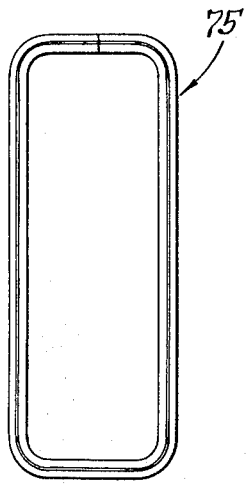
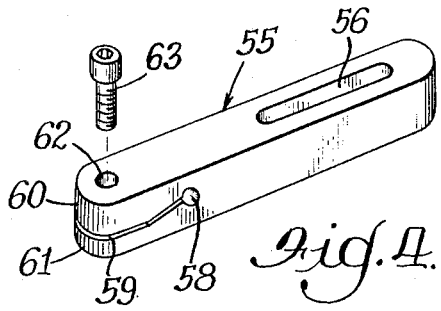
Fig. 4.
Fig. 6.
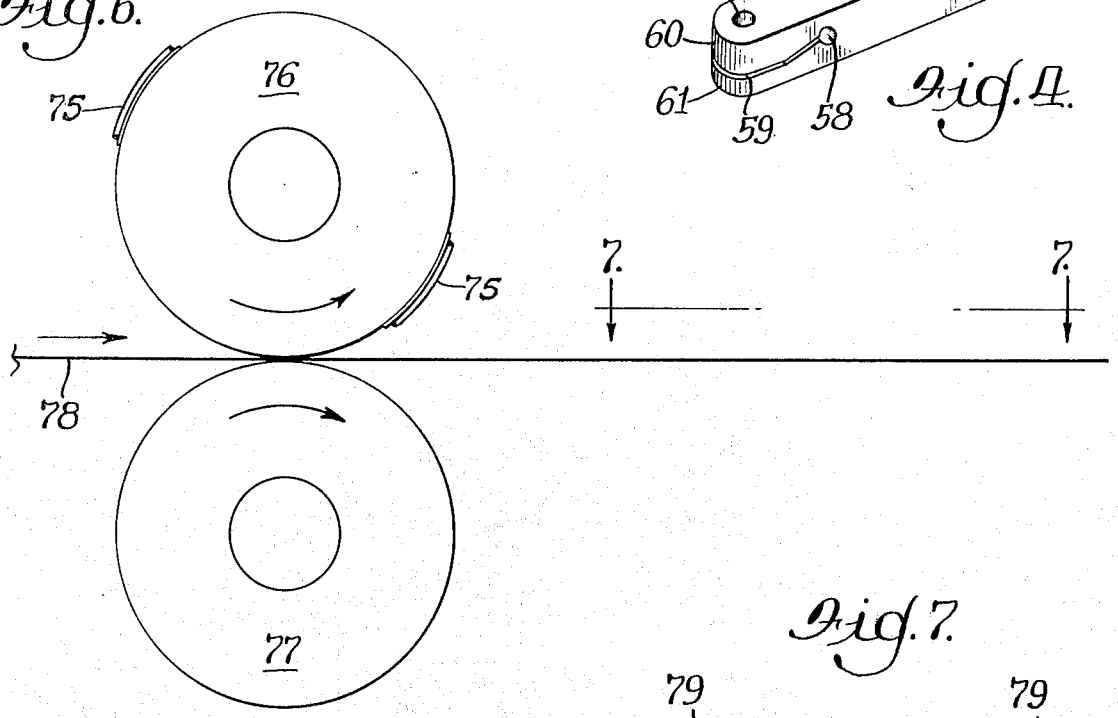
Fig. 7.
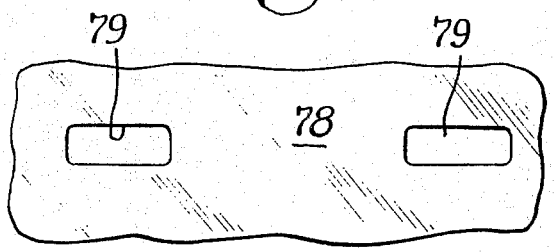

BENDER FOR DIE CUTTERS AND PERFORATORS FOR THE PRINTING INDUSTRY

BACKGROUND OF THE INVENTION

1. Field of the Invention

The printing industry extensively uses die cutters and perforators in their printing operations. These die cutters and/or perforators are mounted on a cylinder and in cooperation with an adjacent anvil cylinder are capable of cutting or perforating a paper web passing therebetween. Until very recently these die cutters and perforators were accurately machined from blocks of steel. This type of construction is of course very expensive and not easily accomplished. A common example of the use of a die cutter is the window envelope where a generally rectangularly shaped opening is cut in the paper and a transparent material placed thereover so the name and address may be seen therethrough.

More recently die cutters and perforators have been made in strip form with an adhesive provided on the back so that selected length pieces could be held in a fixed position on the cutting cylinder. However, most of these have been in just straight form and were primarily designed for cutting slits or perforating a paper web. If a cut-out were desired, great care would have to be taken in arranging pieces on the cylinder so their corners met properly to make a clean cut at these corners.

The present invention is concerned with a device to bend the straight die cutters and/or perforators into any desired shape such as circles, parts of circles, rectangles or other polygonal shapes.

2. Description of the Prior Art

The patent to Boyd U.S. Pat. No. 2,842,202 shows a perforating strip to be used on a cylindrical offset printing press. The Boyd patent drawing shows an inverted "T" shaped strip and an "L" shaped strip in which one of the "L" legs is the cutting portion. The present invention utilizes straight line strips of cutters and perforators such as shown in the Boyd patent and bends that strip into any desired shape without impairing the cutting edges and keeping the "L" or "T" flanges substantially flat for easy and proper adherence thereof to the outer surface of a cylinder used in conjunction with printing devices.

SUMMARY OF THE INVENTION

A principal object of the present invention is to provide a novel bending device for prefabricated die cutters and perforators for the printing industry.

An important object of this invention is to provide novel circular or wheel like devices for gripping the tops and bottoms of the planar side flanges of strips of die cutters and perforators during the bending operation.

Another important object of this invention is to provide a novel bending device as defined in the preceding object and to include one of the circular gripping devices on a swingable arm so that a manual swinging thereof causes that circular strip gripping device to be moved arcuately around another stationary gripping device.

Still another important object of this invention is to provide a novel device as defined in the preceding two objects and including an adjustable gripping device to grip and hold the planar flanges of the strip stock to be bent at any desired position spaced from the bending location of the swinging wheel moving about the stationary wheel.

Other and further important objects and advantages will become apparent from the disclosures in the following specification and accompanying drawings.

IN THE DRAWINGS

FIG. 3 is an enlarged detail sectional view of a portion of the device of FIGS. 1 and 2 as taken on the line 3—3 of FIG. 1.

FIG. 4 is a perspective view detail of the adjustable stock clamp as used in the device of this invention.

FIG. 5 is a top plan view of a prefabricated die cutter formed into a generally rectangular shape by the device of this invention.

FIG. 6 is an end view of a pair of cooperative printing machine rollers on which the formed die cutters of this invention are mounted.

FIG. 7 is a top plan view of the paper web of FIG. 6 showing the cut-outs made by the die cutters of this invention.

AS SHOWN IN THE DRAWINGS

Figure 1:
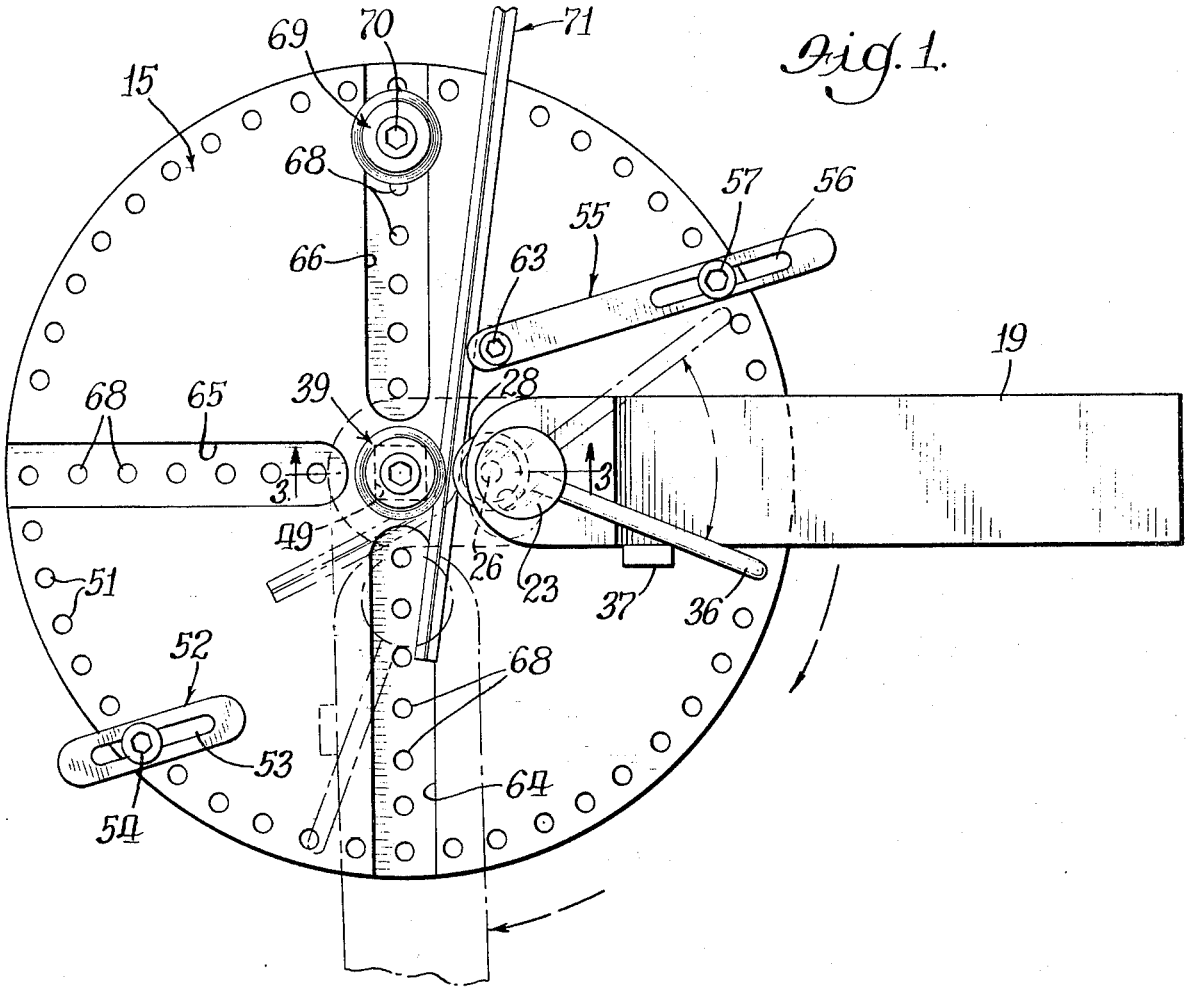
FIG. 1 is a top plan view of the die cutter and perforator bender of this invention.

The reference numeral 10 indicates generally a support or stationary frame on which the bending device of this invention may be mounted. The bender comprises a base 11 which is affixed to the support 10 by means of bolts 12. The base includes a centrally disposed slightly raised and generally circular boss 13 on the top thereof. A center post 14 is formed integrally with the base 11 and is located in the general center of the raised boss 13. The bender further comprises a circular table 15 which is affixed to the center post 14 by means of a key 16. The work table 15 on which the bending is performed is thus held in fixed relationship with the stationary support 10 and the bender base 11.

Figure 2:
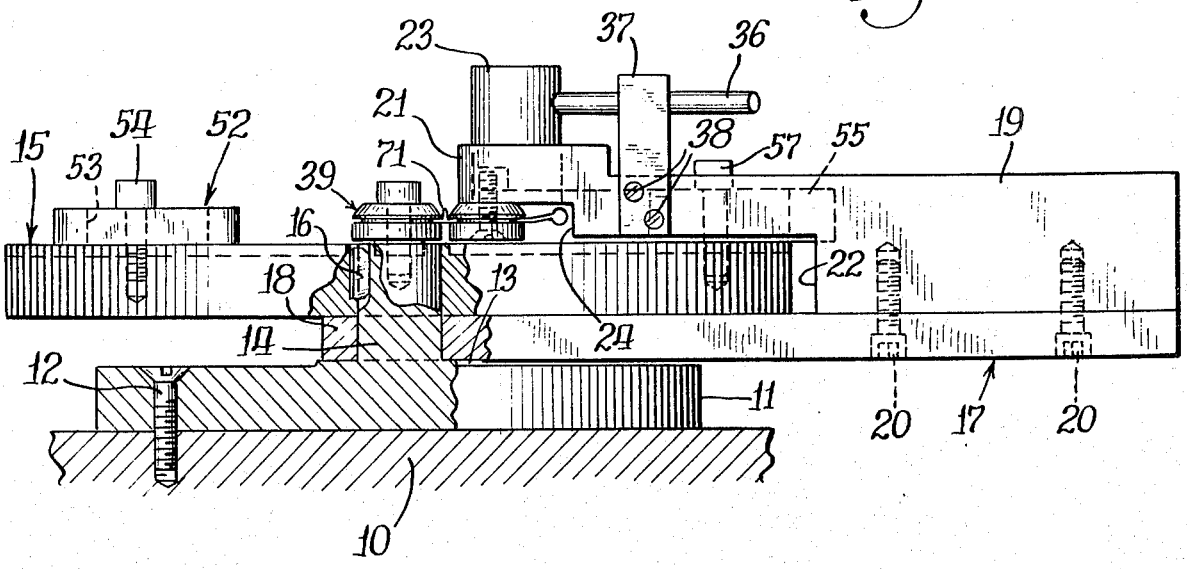
FIG. 2 is a side elevational view, partially in section, of the device as shown in FIG. 1.

Still further, the bender comprises a relatively long arm 17 which is journalled at its inner end 18 over and around the stationary center post 14. The journal mounting of the arm 17 is located vertically between the base 11 and the circular table 15. The long basic arm 17 may thus be swung arcuately around the center post 14 as a central axis. The arm 17 includes an auxiliary portion 19 on the top thereof as best shown in FIG. 2. This top portion 19 is fastened by means of bolts or the like 20 to the basic arm 17. The two arm parts move as an integral unit when the arm is manually swung about its journal mounting 18. The top part 19 of the arm has a radially disposed inward extension 21 which is located over the top of the work table 15. The inward extension 21 is shorter than the basic arm 17 and does not reach the center post 14. The extension 21 is spaced upwardly from the basic arm the distance as shown at 22.

As best shown in FIGS. 1, 2 and 3, a relatively large diameter post 23 is journally mounted for rotation about a vertical axis in the inward extension 21 of the swinging arm 17. An offset shoulder 24 is formed on the underside of the extension 21 so that portion of the extension carrying the rotatable post 23 is spaced above the surface of the table 15. The underside of the post 23 is provided with an eccentric pin 25. The pin 25 includes a threaded upper portion 26 which threadedly engages a threaded hole in the bottom of the post 23. A bending wheel or rotor 28 is journally mounted on a smooth cylindrical portion 29 of the eccentric pin 25. The pin 25 also includes a head 30 on its lower end to hold the bending rotor to the post 23. The bending rotor comprises a lower portion 31 and an upper portion 32. It is clear the enlarged head 30 of the pin 25 engages the underside of the lower portion 31 to simultaneously hold the rotor parts together and hold the entire rotor to the post 23.

The bending rotor is equipped with an annular groove 33 defined between its upper and lower portions thereof. It is within this groove 33 that the flange of the material to be bent is engaged during the bending operation. The bending rotor lower portion 31 is provided with a cup shaped socket 34 which receives a downwardly projecting central pin 35 from the upper portion 32. The telescopic length of the cooperative pin and socket determines the vertical spacing of the annular flange holding groove 33. The shoulder 24 provides clearance for the bending rotor 28 above the table 15. Further the offset position of the shoulder 24 gives lateral clearance for the eccentrically mounted rotor 28. Rotation of the post 23 causes the bending rotor 28 to be moved toward and away from the center post 14. A radially extending spoke-like arm 36 is provided near the upper end of the post 23 to facilitate the manual rotation of the post. A stop 37 is affixed to the side of the inward extension 21 of the arm 17 by means of screws 38. The device is so arranged that when the arm 36 is in abutting engagement with the stop 37 the bending rotor 28 is located closest to the center post 14. Conversely, when the arm is swung away from the stop 37 the eccentrically mounted bending rotor moves away from the center post 14. As will later be understood it is when the rotor is in this spaced position from the center post 14 that stock to be bent is fed into the device for bending.

A cooperative bending wheel or rotor 39 is mounted directly on top of the stationary center post 14. The rotor 39 includes a top part 40 and a cooperative bottom part 41 which corresponds generally to the upper and lower parts of the bending rotor 28. A central pin 42 depends from the top part 40 in the same manner that the pin 35 depends from the upper part 32 of the rotor 28. A central cup shaped socket 43 is provided in the lower part 41 of the rotor 39 to receive the depending pin 42 in telescopic engagement. An annular groove 44 constituting the space between the upper and lower portions is provided on the circumference of the rotor 39 to receive an oppositely extending flange of the material to be bent in this device. A screw 45 holds the components of the rotor 39 together and to the post 14. The screw 45 includes a socket head 46, a cylindrical shank 47, and a threaded lower end 48 as best shown in FIG. 3. The upper end of the center post 14 is provided with a generally square shaped socket 49 which is adapted to receive a downwardly extending square shaped extension 50 from the lower part 41 of the cooperative bending rotor 39. Of course it should be understood the cooperative shapes may be other shapes - they need only be corresponding shapes other than fully circular to provide a rotational locking therebetween. The cooperative downward projection 50 and socket 49 prevent rotation of the lower part 41 of the bending rotor 39.

The table 15 is equipped with a plurality of arcuately spaced apart threaded holes 51. These are arranged in a circular ring around the table and are preferably located just inwardly of the circumference of the table. An adjustable arm stop 52 is arranged for mounting in various positions on the top of the table 15 using the threaded holes 51. The stop includes an elongated slot 53 along its length through which a screw 54 passes to engage any one of the threaded holes 51. Thus the end of the stop may be located in any strategic position atop the table 15. When the screw 54 is drawn up tightly the stop will be locked in its adjusted position and will thus be able to limit the arcuate swinging of the combination arm 17–19.

A stock clamp and guide 55 is also adjustably mounted on the table 15. The clamp 55 is provided with an elongated slot 56 comparable to the elongated slot 53 in the arm stop 52. A position locking screw 57 passes through the slot 56 and is threadedly engaged with an appropriate threaded hole 51 to thus properly locate the clamp on the table as desired. The clamp 55 is utilized to hold the material to be bent at a location spaced from the actual bending portion. The clamp 55 includes a transverse hole 58 near its inner operational end. A slit 59 opens through that operational end and extends rearwardly and slightly upwardly for an open juncture into the transverse hole 58. The slit thus divides the end of the clamp 55 into a top portion 60 and a bottom portion 61. A hole extends in a vertical line through the top and bottom portions 60 and 61 of the clamp 55. A screw 63 is passed loosely through the hole 62 in the top portion 60 and is threadedly engaged in the portion of the hole 62 in the bottom portion 61. This construction permits the top and bottom portions 60 and 61 to act as clamp members in the engagement of a horizontal flange of the material to be bent. When the screw 63 is drawn up tightly the intermediately disposed material flange is positively gripped because the bottom portion 61 is pulled upwardly, and conversely when the screw 63 is loosened the top and bottom members 60 and 61 relax and will no longer lock the flange of the material to be bent therebetween.

The table 15 is provided with a plurality of grooves in its top surface to facilitate the attachment of various auxiliary bending or holding rotors to accomplish the bending of the material to be bent in any desired shape. The grooves, identified as 64, 65, 66 and 67, extend from the circumference of the table inwardly to a location short of the center of the table. The number and spacing of the grooves may be varied as desired, but as shown the grooves divide the circular table 15 into four equal quadrants. Each groove is provided with a series of spaced apart threaded holes 68 which are similar to the circumferential ring of holes 51 in the table 15. As an example of the uses to which these grooves may be put, an auxiliary stock clamping rotor 69 is shown disposed in the groove 66. This auxiliary rotor is fastened to to one of the threaded holes 68. This particular location was selected to accommodate the making of the generally rectangularly shaped die cutter of FIG. 5. A screw 70 is arranged to pass through the rotor 69 to hold the rotor in the surface groove in the same manner as the screw 46 holds the rotor 38 to the center post 14.

The stock to be bent is a paper die cutter or perforator and in the present instance is an inverted "T" shaped die cutter 71. This cutter comes in straight strip form and as stated above has been used in this form for adherence to cooperative cutting rollers in a printing press for effecting straight line cutting of a paper web. Now, with the device of this invention this straight strip may be formed and bent into any desired geometric shape to effect cut-outs of these shapes in paper webs. The strip 71 comprises a vertically disposed blade cutter 72 with a continuous upper edge or with an upper edge which is intermittent to effect a perforating of the paper web. At the base of the cutting blade 72 there is preferably provided oppositely projecting bottom flanges 73 and 74. The flanges lie in a horizontal plane when the centrally disposed cutting edge 72 is vertically positioned.

The operation of bending of the inverted "T" strip material provides for the insertion of a straight strip into the various clamping and bending rotors on the table 15. The screw 63 is loosened and the one flange of the paper cutter or perforator strip is slid through the slit 59 in the operational end of the clamp arm 55. A spaced apart portion of the strip has its opposite flange inserted through the annular groove 44 in the center post rotor as shown in all of FIGS. 1, 2 and 3. This is done at a time when the eccentrically mounted bending roller 28 is swung away from the center post 14. Now, the post 23 is rotated by swinging the arm 36 toward its stop 37 which causes the roller 28 to have its annular slot 33 slide over the flange of the strip 71 opposite to the flange held in the center post roller as the roller 28 moves toward the center post. A desired amount of the strip to be bent is permitted to extend outwardly beyond the cooperative bending rotors 28 and 30. The screw 63 of the clamp 55 is then tightened to securely grip the strip at a short distance from where the material is to be bent. Now the arm 17 is manually swung around the center post as an axis causing the bending roller 28 to move around the circumference of the post held roller 30 and carrying with it the strip of material to be bent as is shown in dash lines in FIG. 1. Here the stop 52 is set to make a right angle bend in the strip 71 when the arm 17 hits that stop. With the flanges on both sides of the strip securely guided during the bending there is no distortion of the strip during bending. The amount of radius of the right angle or other angle bend is determined by the diameter of the rollers 28 and 30 which combine to form the bending means of this invention. The rollers should be understood to be replaceable with any diameter rollers desired. The stock strip is then moved as desired to complete the bending of any geometric pattern. The originally made right angle bend may be locked in the auxiliary roller 69 to make or complete a rectangularly shaped paper cutter or perforator. Again, the clamp 55 is adjusted to move its holding slit 59 at a position closely adjacent the new bend to be made and the strip again threaded through the grooves 33 and 44 of the cooperative bending rollers 28 and 30 for the making of another bend.

This procedure is repeated as necessary to produce the desired pattern. FIG. 5 shows a paper cutter strip or perforator which has been bent into a rectangular shape as indicated at 75. The ends of the strip meeting at the top may just abut one another or may be welded as desired.

The use of the bent and formed cutter frame 75 is clearly shown in FIGS. 6 and 7. A cylindrical cutter roller 76 is adapted to have one or more such frames 75 adhered to its outer cylindrical surface thereof. A cooperative cylindrical anvil roller 77 mates with the roller 76 so that when a paper web 78 passes therethrough during a printing process, portions of the paper web are cut out as shown by the rectangular cut-outs 79 in FIG. 7. This cutout web may then be folded to make window envelopes or any other article as desired.

I am aware that numerous details of construction may be varied throughout a wide range without departing from the principles disclosed herein and I therefore do not intend limiting the patent granted hereon otherwise than as necessitated by the appended claims.

What is claimed is:

1. A bender for horizontal flanged strips of prefabricated die cutters and perforators for the printing industry comprising a generally stationary horizontal table, an arm pivotally mounted for movement in a horizontal plane relative to said table about a vertical axis, a stationary wheel mounted on said table directly on said vertical axis, means on said stationary wheel for gripping the upper and lower surfaces of a flange of the strips of die cutters and perforators, a cooperative circular bending wheel mounted on said arm, an eccentric mounted on said arm and having the bending wheel carried thereby, means rotating said eccentric to move said bending wheel toward or away from said stationary wheel, means on said bending wheel for gripping the upper and lower surfaces of a flange of the strips of die cutters and perforators opposite the flange engaged by said stationary wheel, said gripping means of the stationary wheel and the bending wheel lying in the same plane, said table including a plurality of threaded holes in the surface thereof, a flange clamping member removably mounted to said table by screw means threadedly engaging any one of the plurality of threaded holes, said clamping member having a generally longitudinally disposed slit extending inwardly from one end thereof and dividing the clamp into upper and lower portions at that end, and adjustable screw means to tighten or loosen the upper and lower portions to thereby grip or release a flange disposed in said slit.

2. A device as set forth in claim 1 in which the bender further includes a stop member having an elongated slot therein, and screw means for effecting the removable positioning of the stop member at any desired position on said table by engaging one of the threaded holes in the surface of said table, and said stop member acting to limit swinging movement of said arm relative to said table.

3. A device as set forth in claim 1 in which there is further included an auxiliary circular wheel-like member removably affixed to said table, and annular slot means in said auxiliary member for engaging and gripping a flange of the strips of the die cutters and perforators to be bent at some selected position spaced from said cooperative circular bending wheel and said stationary circular wheel-like member.

4. A device as set forth in claim 1 in which the plurality of threaded holes in the surface of the table includes a circular path of threaded holes in the surface thereof near the circumference of said table, said table surface further having a plurality of spaced apart radial grooves extending from the outer circumference of the table inwardly to a position just short of said stationary circular wheel-like member, said plurality of threaded holes in the surface of the table further including a plurality of spaced apart threaded holes in the radial grooves in said table, and said device including flange engaging and gripping devices removably mounted on said table and in said grooves by employing screw means to engage any desired threaded hole in the surface of said table for effecting and reproducing any desired bend or series of bends in the material to be bent.

* * * * *